US005660044A

United States Patent [19]

Bonciani et al.

[11] Patent Number: 5,660,044

[45] Date of Patent: Aug. 26, 1997

[54] PERFECTED COMBUSTION SYSTEM WITH LOW POLLUTING EMISSIONS FOR GAS TURBINES

[75] Inventors: Luciano Bonciani, Florence; Gianni Ceccherini, Sesto Fiorentino; Roberto Modi, Borgo S. Lorenzo, all of Italy

[73] Assignee: Nuovopignone S.p.A., Florence, Italy

[21] Appl. No.: 389,501

[22] Filed: Feb. 16, 1995

[30] Foreign Application Priority Data

Mar. 4, 1994 [IT] Italy ..... MI94A0386

[51] Int. Cl.[6] ..... F23R 3/28

[52] U.S. Cl. ..... 60/737; 60/746; 60/760

[58] Field of Search ..... 60/39.23, 733, 60/737, 746, 748, 760; 431/12, 352, 353, 243

[56] References Cited

U.S. PATENT DOCUMENTS

| | | | |
|---|---|---|---|
| 3,958,416 | 5/1976 | Hammond et al. | 60/39.23 |
| 4,603,548 | 8/1986 | Ishibashi et al. . | |
| 4,967,561 | 11/1990 | Brühwiler et al. . | |
| 4,982,570 | 1/1991 | Waslo et al. | 60/733 |
| 5,049,610 | 9/1991 | Mandai et al. . | |
| 5,081,843 | 1/1992 | Ishibashi et al. . | |
| 5,121,597 | 6/1992 | Urushidani et al. . | |
| 5,381,652 | 1/1995 | Mezzedimi et al. | 60/39.23 |

FOREIGN PATENT DOCUMENTS

| | | | |
|---|---|---|---|
| 894054 | 4/1962 | United Kingdom | 60/737 |

*Primary Examiner*—Louis J. Casaregola
*Attorney, Agent, or Firm*—Nixon & Vanderhye

[57] ABSTRACT

Combustion system with low polluting emissions for gas turbines, of the pre-mixing type, wherein a series of parallel burners, autonomously fed with additional fuel, is circumferentially arranged around the conjunction choke of the pre-mixing chamber with the combustion chamber, to create in the combustion zone immediately before the choke a corresponding series of additional flames for the stabilization of the main flame, the combustion air for the burners deriving from the cooling air of the tapered head of the combustion chamber, which is sent to the burners through twirled blades to give a substantially helicoidal movement to the air.

1 Claim, 2 Drawing Sheets

PERFECTED COMBUSTION SYSTEM WITH LOW POLLUTING EMISSIONS FOR GAS TURBINES

BACKGROUND OF THE INVENTION

1. Field of the Invention

The present invention relates to a new combustion system for gas turbines which, by using additional burners reducing the quantity of additional fuel necessary for the stabilization of the flame and enabling the exact quantity of air and fuel used by the burners themselves to be known, permits not only an excellent and safe ignition of the flame in the combustion chamber i.e. an instantaneous ignition and therefore without pressure waves, but above all a drastic minimization of polluting emissions of nitrogen oxide at all the charge levels of the turbine.

More specifically, the present invention relates to a perfected combustion system with low polluting emissions for gas turbines, as described in Italian patent application MI92 A 002189 filed on Sep. 24, 1992 by the same Applicant.

2. Discussion of the Background

The above patent application relates to a combustion system for a gas turbine, of the pre-mixing type i.e. wherein before the combustion chamber, and separated therefrom by a choke, a pre-mixing chamber is used which, together with the combustion chamber, is surrounded by an air space under circulating pressure countercurrent to the flow of combustion products leaving said combustion chamber, this air being used as combustion air to be mixed with the fuel in the pre-mixing chamber and as cooling air both for the combustion chamber and combustion products. Subsequently, in order to have low polluting emissions of nitrogen oxide at all charge levels of the turbine, in the above known combustion system the passage of combustion air from said air space to the pre-mixing chamber, through windows present in the external surface of the latter, is divided in relation to the quantity of fuel used in order to maintain the ratio combustion air/fuel at the optimum value; in addition, the cooling air of the tapered head and part of the combustion chamber which is immediately after said choke, is sent down into a cooling chamber which communicates with said combustion chamber by means of collector holes situated in the wall of the combustion chamber itself, far away from the choke. On the other hand, to avoid extinguishment or instability of the flame, an anular series of small holes is situated in the surface of said choke for an additional injection of fuel necessary for enriching the combustion area immediately after said choke with fuel.

It has now been experimentally observed that this known combustion system, even if it is capable of considerably reducing the polluting emissions of nitrogen oxide with respect to the traditional systems, continues, in fact, to produce polluting emissions, most of which can be basically attributed to the concentrated injection of additional fuel into the combustion area immediately after the choke, through said anular series of small holes situated in the surface of the choke itself. In fact, by reducing the quantity of fuel injected into this area, there is a considerable reduction of nitrogen oxide.

As the above reduction, however, obviously cannot be prolonged over a certain limit without jeopardizing the stability of the flame, it is evident that a combustion system like the one described, is absolutely unable to minimize the polluting emissions of nitrogen oxide to the extreme.

SUMMARY OF THE INVENTION

The purpose of the present invention is to overcome said drawbacks and consequently provide a combustion system of the pre-mixing type for a gas turbine which, by drastically reducing the additional fuel required, actually minimizes the polluting emissions maintaining the stability of the flame.

This is substantially achieved by the fact that, instead of utilizing said anular series of small holes situated in the surface of the choke and fed with additional fuel, a series of parallel burners is used, circumferentially arranged around the choke in order to create a corresponding series of additional flames in the area immediately after said choke, these burners being autonomously fed with additional fuel and also with the combustion air deriving from the cooling air of the tapered head of said combustion chamber, this air being sent to the burners through twirled blades to give a substantially helicoidal movement to the air.

In this way, in fact, with the additional flames of the burners, which are basically pilot flames, not only is the main central flame of the combustion system stabilized, precluding any extinguishment but, by knowing the exact quantity of fuel and air autonomously used by the burners, it is also possible to regulate anything to obtain an excellent, controlled ignition i.e. a safe, repeatable and above all instantaneous ignition which is consequently without pressure waves.

On the other hand, the required quantity of additional fuel for the flame of the burners is now extremely reduced and it is also entirely burnt under excellent conditions and therefore the polluting emissions of nitrogen oxide are drastically reduced.

In conclusion, the combustion system with low polluting emissions for gas turbines, comprising a combustion chamber equipped with small deflector openings for the cooling air, which are distributed on the surface of the chamber except in correspondence with the tapered head and combustion area or main flame, said combustion chamber being surrounded by an air space under circulating pressure countercurrent to the flow of combustion products, this space also surrounding a pre-mixing chamber which, before said combustion chamber and separated therefrom by a choke, mixes the fuel with combustion air taken from said air space by means of openings arranged in relation to the quantity of fuel used, is characterized according to the present invention in that a series of parallel burners suitable for creating a corresponding circular series of additional flames concentric to said main flame, is circumferentially arranged outside said choke joining the pre-mixing chamber with the combustion chamber, said burners being autonomously fed with additional fuel as well as with combustion air coming from the cooling air of said tapered head of said combustion chamber, which, contained in a small chamber edged by the wall of said head and by an external wall equipped with numerous small holes, is sent to the burners by means of twirled blades in order to give a substantially helicoidal movement to the air.

BRIEF SUMMARY OF THE DRAWINGS

The invention is now more clearly explained with reference to the enclosed drawings which illustrate a preferential practical embodiment which is only illustrative and not restricting as technical or constructive variations can always be applied but still remaining within the scope of the present invention.

In these drawings.

DESCRIPTION OF THE PREFERRED EMBODIMENT

Figure 1:
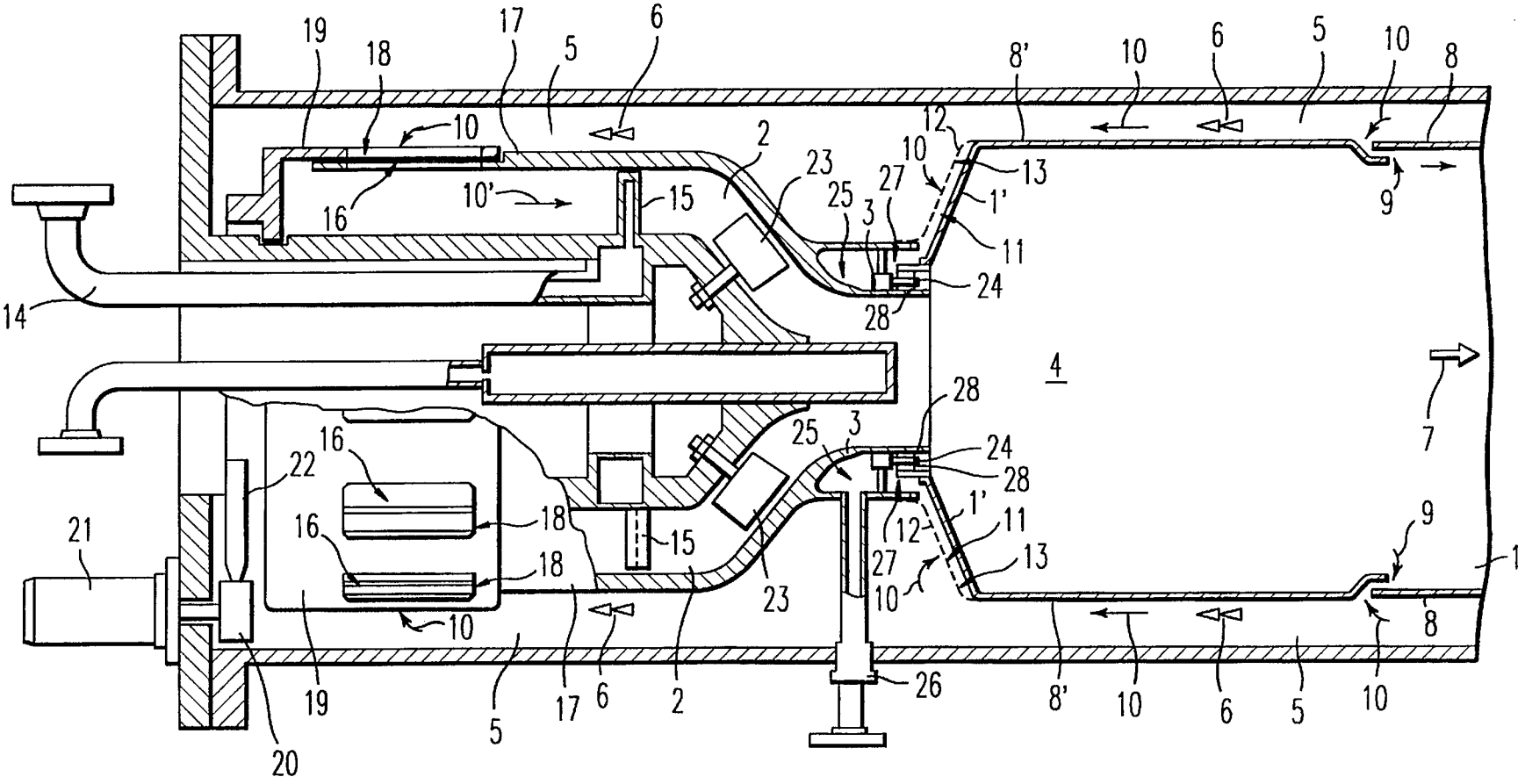
FIG. 1 shows a longitudinal sectional view of a combustion system with low polluting emissions for gas turbines embodied according to the invention.
Figure 2:
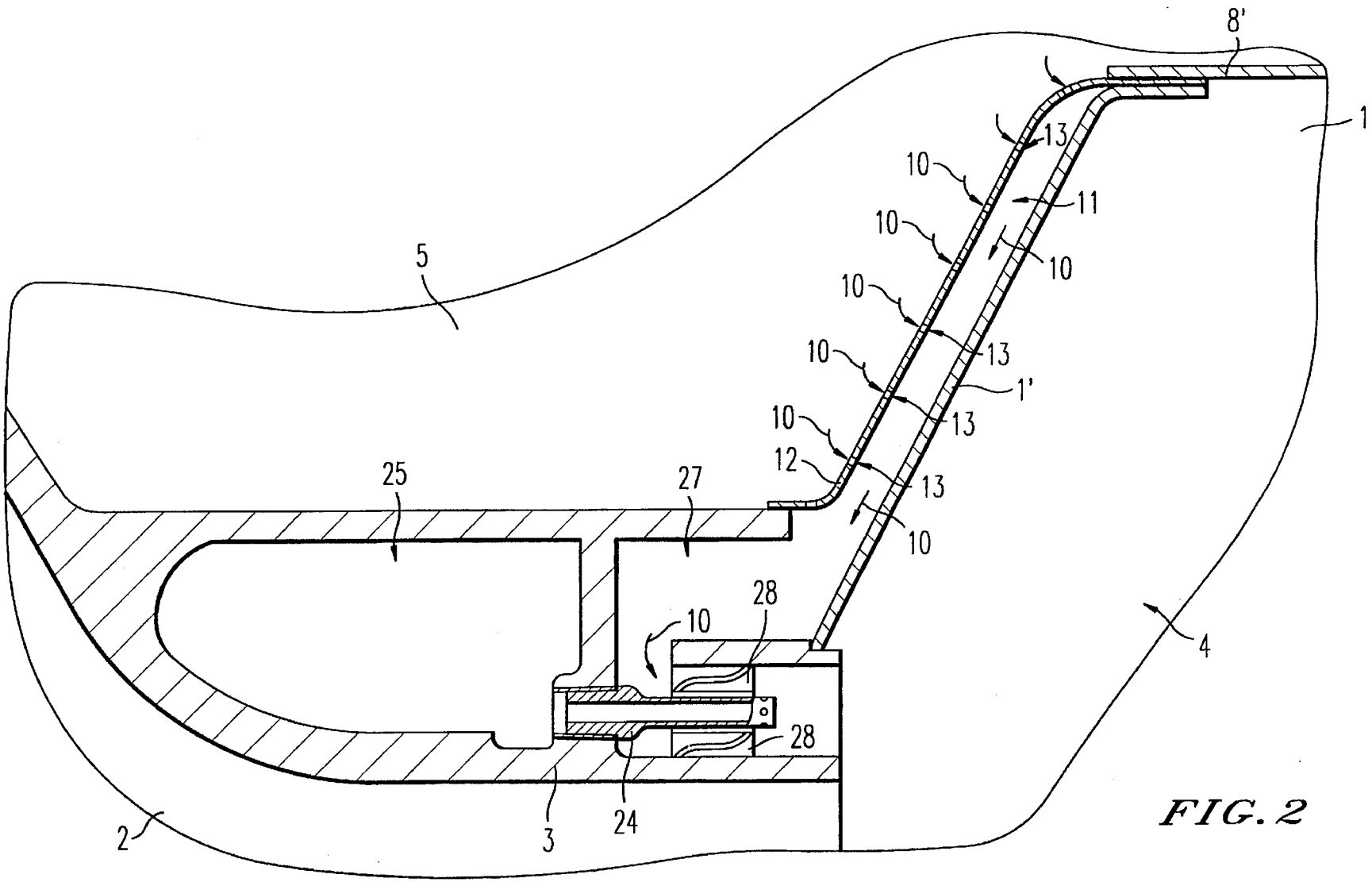
FIG. 2 shows a considerably enlarged longitudinal sectional view of a particular aspect of the system of FIG. 1.

With reference to the Figures, a combustion chamber 1 of the combustion system for gas turbines is provided, whose tapered head 1' is connected to a pre-mixing chamber 2 by means of a choke 3 immediately after which there is the real combustion area 4 or main flame of the chamber 1. All of this is surrounded by an air space 5 put under pressure by an axial compressor not shown in the figure and circulating in the direction of arrow 6, i.e. countercurrent to the flow 7 of the combustion products leaving the combustion chamber 1. The external surface 8 of the combustion chamber 1 is equipped with small deflector openings 9 for the cooling air 10 of the chamber itself, whereas the part 8' of the surface 8, which corresponds with said combustion area 4, as well as said head 1' have no openings and their cooling is carried out directly by the air 10 for said part 8' and, by means of an anular chamber 11 formed by said wall of said head 1' and by an external wall 12 equipped with numerous small inlet holes 13 for the air 10, for the tapered head 1'.

The pre-mixing chamber 2 is also fed with fuel by means of pipe 14 and a radial series of perforated pipes 15, whereas the combustion air 10' (see FIG. 1) is sent to the air space 5 in the pre-mixing chamber 2 through a series of windows 16 present in the external surface 17 of said chamber. These windows 16 then cooperate with corresponding windows 18 of a rotating drum 19 on said external surface 17, which is rotated by the pinion 20 of an actuator 21, which engages a solidal sector gear 22 with the drum itself 19, in order to partialize the light of said windows 16 in relation to the quantity of fuel used. In said pre-mixing chamber 2 and near the choke 3 there are blades 23, which, arranged with a pre-set registrable angulation with respect to the flow of the air-fuel mixture, give a more or less forced rotating movement to the mixture itself which favors the stabilization of the main flame.

Finally, outside said choke 3 there is a circumferential series of parallel burners 24 suitable for creating in said combustion area 4, immediately after the choke 3, a corresponding anular series of additional flames which is concentric to said main central flame. Said burners 24 are fed with additional fuel through the annular chamber 25 and pipe 26 as well as with combustion air deriving from said anular chamber 11 from which it is sent to the burners 24 through anular channel 27 and twirled blades 28 in order to give a substantially helicoidal movement to the air 10.

We claim:

1. Combustion system with reduced polluting emissions for gas turbines, which comprises:

a combustion chamber equipped with a tapered head, a combustion area and having small deflector openings supplying cooling air which are distributed on a surface of the chamber except in an area corresponding with said tapered head and said combustion area of the combustion chamber, said combustion chamber generating a main flame and being surrounded by an air space which has a circulating airflow flowing therethrough;

a choke located upstream of the combustion chamber;

a pre-mixing chamber surrounded by said air space wherein said premixing chamber is located upstream of said combustion chamber and is separated therefrom by said choke, said premixing chamber mixing fuel with combustion air from said air space;

a series of parallely oriented burners creating a corresponding circular series of additional flames which are concentricly disposed with respect to said main flame and circumferentially arranged radially outwardly of said choke, said burners having fuel fed thereto and having combustion air fed thereto in an annular chamber formed by a wall of said tapered head and by a second wall located externally thereof and housing a plurality of holes formed therein; and a plurality of blades which helicoidally move air from said annular chamber to said combustion chamber.

* * * * *